US005886621A

United States Patent [19]

Clark

[11] Patent Number: 5,886,621

[45] Date of Patent: Mar. 23, 1999

[54] TALKING POSTER

[75] Inventor: Aaron D. Clark, 77 Oaks Valley Dr., Reynoldsburg, Ohio

[73] Assignees: Aaron D. Clark; John K. Peirano, both of Reynoldsburg, Ohio

[21] Appl. No.: 967,557

[22] Filed: Nov. 12, 1997

Related U.S. Application Data

[63] Continuation of Ser. No. 666,136, Jun. 19, 1996, abandoned, which is a continuation-in-part of Ser. No. 651,332, May 22, 1996, Pat. No. 5,710,422, which is a continuation-in-part of Ser. No. 402,195, Mar. 10, 1995, Pat. No. 5,548,272.

[51] Int. Cl.[6] ..... G08B 3/00

[52] U.S. Cl. ..... 340/384.1; 340/384.7; 340/328; 340/407.1; 40/455; 40/457; 40/463; 40/717

[58] Field of Search ..... 340/407.1, 206.11, 340/384.1, 384.7, 328; 40/455, 906, 457, 463, 717, 124.1

[56] References Cited

U.S. PATENT DOCUMENTS

| | | | |
|---|---|---|---|
| 3,978,598 | 9/1976 | Rose et al. | 409/106.52 |
| 4,299,041 | 11/1981 | Wilson | 40/124.1 |
| 4,607,747 | 8/1986 | Steiner | 206/232 |
| 4,934,079 | 6/1990 | Hoshi | 40/427 |
| 4,943,256 | 7/1990 | Symons | 446/278 |
| 5,051,728 | 9/1991 | Wang | 340/573 |
| 5,063,698 | 11/1991 | Johnson et al. | 40/124.1 |
| 5,309,519 | 5/1994 | Park et al. | 381/190 |
| 5,359,374 | 10/1994 | Schwartz | 381/76 |
| 5,480,156 | 1/1996 | Doederlein et al. | 273/237 |
| 5,548,272 | 8/1996 | Clark | 340/407.1 |
| 5,710,422 | 6/1998 | Clark | 340/384.1 |

*Primary Examiner*—Jeffery A. Hofsass
*Assistant Examiner*—Julie B. Lieu
*Attorney, Agent, or Firm*—Standley & Gilcrest

[57] ABSTRACT

An talking poster is disclosed. A sound module is attached to the back of the poster. The sound module includes a speaker, which is preferably covered by a speaker cover. A portion of the poster is folded over and sealed to the back of the poster, concealing the sound module. A method of making the poster is also disclosed.

3 Claims, 3 Drawing Sheets

TALKING POSTER

This application is a file wrapper continuation of application Ser. No. 08/666,136 file Jun. 19, 1996, now abandoned which is a continuation-in-part of U.S. patent application Ser. No. 08/651,332, filed May 22, 1996, now U.S. Pat. No. 5,710,422, entitled TALKING POSTER which is a continuation-in-part of U.S. patent application Ser. No. 08/402,195, filed Mar. 10, 1995, now U.S. Pat. No. 5,548, 272.

BACKGROUND AND SUMMARY OF TBE INVENTION

The present invention relates generally to the art of posters and more particularly to a talking poster that projects a recorded sound using a device attached to the poster.

Poster sales are primarily dependent upon the novelty and attraction of individual posters. Posters must not only contain subject matter that is appealing, but must also be of high quality to be attractive to consumers.

The present invention is designed to provide a poster with a prerecorded message that may be played back on command. The invention uniquely provides the poster with the sound equipment without interfering with the artwork on the poster. The present invention allows the sound hardware to be placed anywhere on the surface of the poster artwork. It also allows conventional posters to be adapted for sound, which was previously considered impossible.

Other principal features and advantages of the invention will become apparent to those skilled in the art upon review of the following detailed description, claims, and drawings.

BRIEF DESCRIPTION OF THE DRAWINGS

The various features and advantages of the present invention may be more readily understood with reference to the following description taken in conjunction with the accompanying drawings, wherein like reference numerals designate like structural elements, and in which.

DESCRIPTION OF THE INVENTION

The assembly of the present invention includes a poster comprised of a first material. The poster has a first area and a second area. The poster has a first surface and a second surface. The first area of the poster has poster art on it. There is a speaker which is operatively connected to an electric circuit including a sound production component. A trigger is attached to the electric circuit, the trigger being adapted to be actuated through the first area of the poster to produce the sound. The second area of the poster is folded over the speaker and the electric circuit. The second surface of the second area is sealed to the second surface of the first area, such that the speaker and the electric circuit are concealed between the second surface of the second area and the second surface of the first area.

The electric circuit preferably includes a circuit board, at least one battery attached to the circuit board, and a speech chip.

The assembly preferably includes a speaker cover comprised of a second material attached to the second surface of the poster. The speaker is concealed between the speaker cover and the second surface of the poster. The speaker cover preferably has an inner circle and an outer circle. The speaker is preferably located in the inner circle of the speaker cover.

The invention also includes a method for making a talking poster. The method includes (i) providing a poster having a first area and a second area, the poster having a first surface and a second surface, and the poster having poster art on the first area thereof, (ii) providing human actuatable sound components, (iii) folding the second area over the human actuatable sound components, and (iv) sealing the second surface of the second area to the second surface of the first area, such that the human actuatable sound components are concealed between the second surface of the second area and the second surface of the first area. The sound actuatable components are preferably secured to the second surface before the second surfaces are sealed together.

The invention preferably also includes providing a speaker cover adapted to be secured onto the second surface of the poster. The human actuatable sound components include a speaker. The speaker is concealed in the speaker cover, and the speaker cover is concealed between the second surface of the second area and the second surface of the first area.

Figure 1:
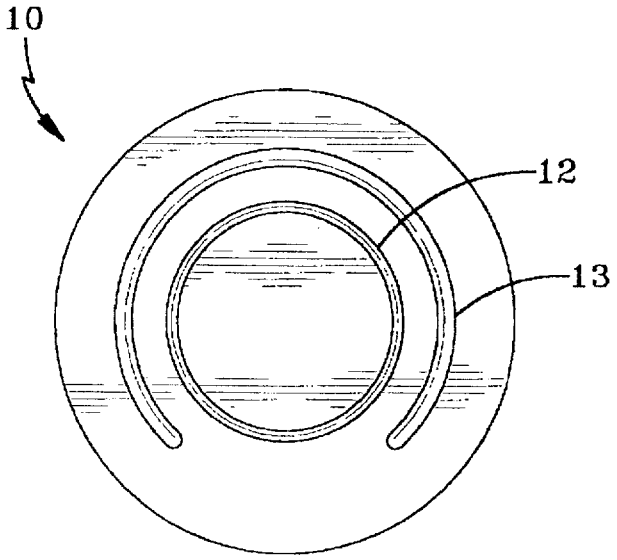
FIG. 1 is a back view of the preferred speaker cover of the present invention.

FIG. 1 shows the back of the preferred speaker cover 10 of the present invention. Speaker cover 10 is shown in its vacuum formed shape. The speaker cover 10 has a raised inner circle 12 and a raised outer circle 13. The speaker is concealed in inner circle 12. A sound chamber is created in the area between the inner circle 12 and outer circle 13. The sound which is emitted from the rear of the speaker reverberates in the empty chamber formed by the inner circle 12 and outer circle 13. This provides a sound which is richer, fuller in quality, and louder in volume than either the speaker alone or the speaker cover with only the inner circle. This arrangement allows greatly improved sound quality without using more expensive sound components.

Figure 2:
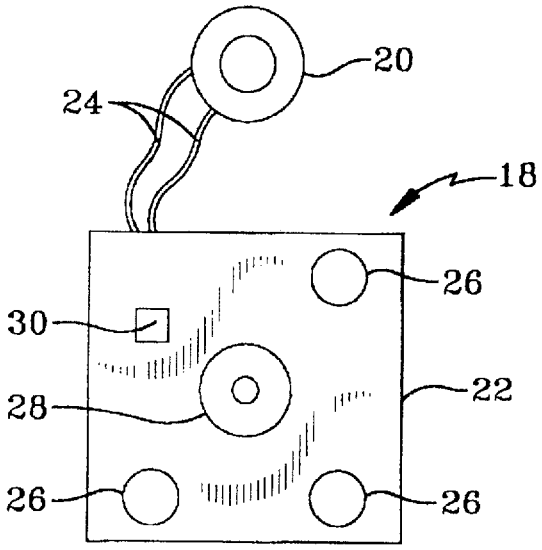
FIG. 2 is a plan view of an embodiment of an electrical circuit of the present invention.

FIG. 2 shows an electric circuit 18 used in the present invention. Circuit 18 may include a speaker 20 attached to a circuit board 22 with wires 24. One or more batteries 26 may be used to power the circuit and a push button switch 28 may be used to trigger the sounds. Speech chip 30 may be used to control the circuit with the necessary logic.

Figure 3:
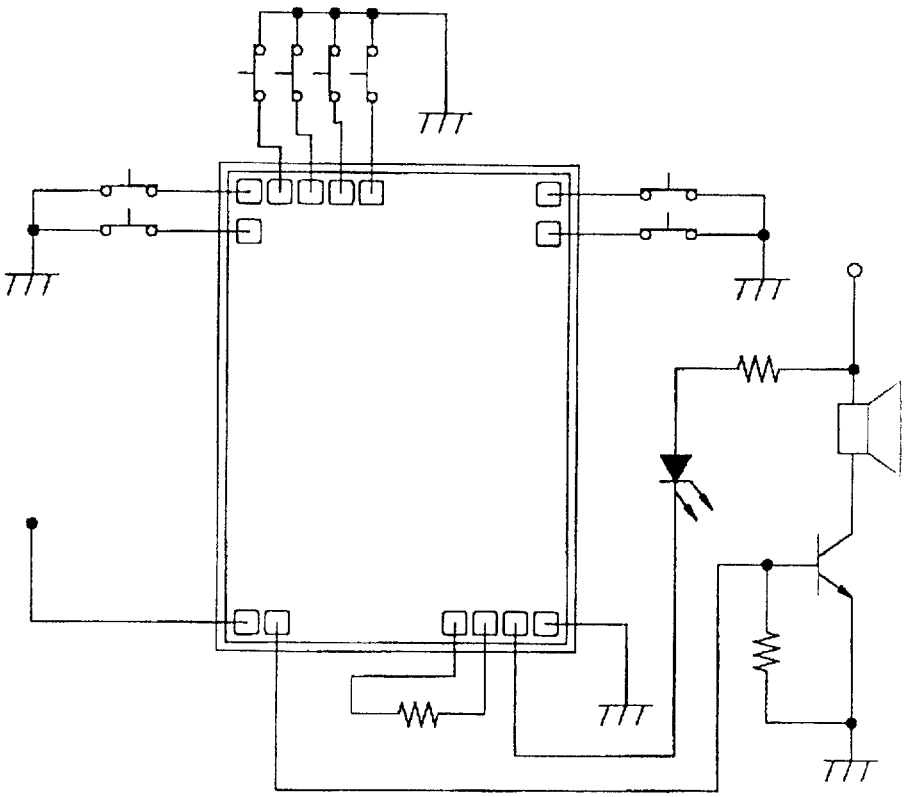
FIG. 3 is a schematic view of an application circuit for an embodiment of a speech chip of the present invention.

FIG. 3 shows a schematic of an application circuit of a preferred embodiment of the present invention that utilizes a speech chip. The speech chip may be a Holtek model HT-81400 or a comparable model.

Figure 4:
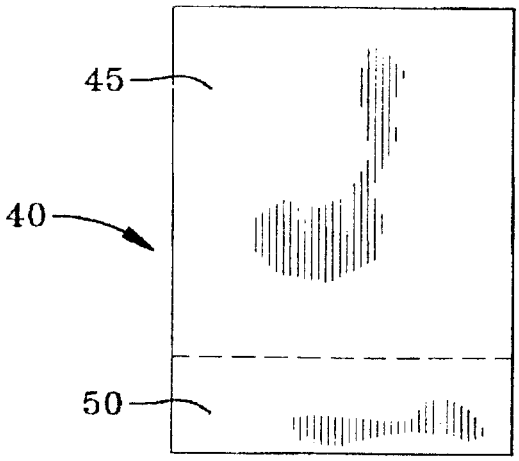
FIG. 4 is a plan view of a talking poster of the present invention.
Figure 5:
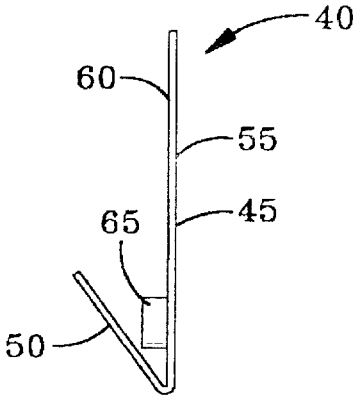
FIG. 5 is a side view of a talking poster of the present invention during production.
Figure 6:
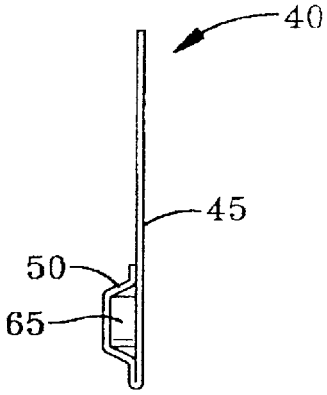
FIG. 6 is a side view of a finished talking poster of the present invention.

The method of making the poster can best be understood by reference to FIGS. 4, 5, and 6. The poster 40 has a first area 45 and a second area 50. First area 45 is larger than second area 50 the dotted line separating the first and second areas is there for purposes of illustration only and would not appear on the poster. The poster art can be printed on the first area using any suitable printing process. The poster art is preferably printed on the front of the poster. It could also be reverse printed on the back of the poster, depending on the material selected for the poster. The second area is preferably left blank The poster art could also be printed on the second area if desired.

As shown in FIG. 5, the poster 40 has a first surface 55 and a second surface 60. In the preferred method of making the poster, the sound module 65 including the speaker, the electric circuit, and the trigger is secured to the second surface 60 of the first area 45 of the poster 40. In this arrangement, the trigger would be facing the poster so that it could be activated. The sound module 65 can be attached to the second surface 60 of the poster 40 in any conventional way, such as by spot gluing. The speaker cover is then attached to the second surface 60 of the poster 40, covering the speaker. The speaker cover can be mounted on the poster in any customary way, for example using glue or an adhesive.

The second area 50 of the poster is then folded over to cover the speaker cover and the rest of the sound module 65. The second surface 60 of the second area 50 of the poster is then sealed to the second surface 60 of the first area 45, as show in FIG. 6. The sealing can be accomplished in any conventional manner, such as by gluing. The speaker cover and the rest of the sound module 65 are thus concealed between the second surfaces of the first and second areas.

Although the sound module and speaker cover are shown as being attached to the second surface of the first area, they could also be attached to the second surface of the second area. In this situation, the trigger would have to be facing away from the poster, so that when the second area was folded over and sealed, the trigger could be activated through the poster.

While the second area is shown as being on the bottom of the poster, it could be located on the top or the sides. The location of the second area is determined by the desired placement of the sound module. This invention will allow the sound module to be placed anywhere on the poster. The poster will cost more to make the farther the sound module is placed from the edge of the poster, since more poster paper will be needed to fold over the sound module.

The speaker cover can be made of paper, cardboard, plastic, or any other suitable material. The speaker cover preferably comprises 0.010" thick clear polyvinyl chloride (PVC) sheet. The speaker cover may be vacuum-formed to achieve the desired final configuration. Preferably, the forming is accomplished by clamping the sheet in a frame and heating it with a radiant heat oven to approximately 240 degrees Fahrenheit. After reaching the desired forming temperature, the sheet is pliable and may be pulled down over the molds. A vacuum may be applied to assist the material in conforming to the shape of the mold. Cooling fans may be used to cool the sheet while on the molds until the material is rigid enough to remove from the molds.

While the sheet is still in the mold, a piece of double-sided adhesive material may be adhered to the back side of the sheet. The sheet may then be placed in a steel rule die and cut to conform to the desired shape of the product. The speaker cover may then be attached to the surface of poster with the adhesive material.

The poster could also be made without using a speaker cover to enclose the speaker. In this case, the sound module would be placed between the second surfaces of the first and second areas which would then be sealed. The sound module could be attached to the second surface of the poster prior to folding and sealing. It can be more difficult to ensure proper placement of the sound components using this method.

The scope of the invention is not to be considered limited by the above disclosure, and modifications are possible without departing from the spirit of the invention as evidenced by the following claims.

What is claimed is:

1. An assembly, comprising:

a speaker, an electronic circuit including sound production component for producing a sound, operatively connected to said speaker, said electronic circuit comprised of:

a circuit board;

at least one battery attached to the circuit board;

a speech chip a trigger attached to said electric circuit;

a poster comprised of a first material, said poster having a first edge and a second edge opposite said first edge, said poster having a first area and a second area, said first area extending a first distance from said first edge of said poster to an edge of said second area parallel to said first edge and said second edge, said second area extending a second distance from said second edge of said poster to said edge of said second area parallel to said first and second edges, said first distance being greater than said second distance, said poster having a first surface and a second surface, and said poster having poster art on said first area thereof, said second area of said poster being folded over said speaker, said electric circuit, and said trigger, said trigger adapted to be actuated through said first area said poster to produce said sound, and said second surface of said second area being sealed to said second surface of said first area, such that said speaker and said electric circuit are concealed between said second surface of said second area and said second surface of said first area;

wherein said speaker having a speaker cover comprised of a second material, said speaker cover attached to said second surface of said poster such that said speaker is concealed between said speaker cover and said second surface, wherein said speaker cover has an inner circle and an outer circle separated from said inner circle forming a sound chamber therebetween, and wherein said speaker is located in said inner circle of said speaker cover.

2. A method for making a talking poster, comprising:

providing a poster having a first edge and a second edge opposite said first edge, said poster having a first area and a second area, said first area extending a first distance from said first edge of said poster to an edge of said second area parallel to said first edge and said second edge, said second area extending a second distance from said second edge of said poster to said edge of said second area parallel to said first and second edges, said first distance being greater than said second distance, said poster having a first surface and a second surface, and said poster having poster art on said first area thereof;

providing human actuatable sound components including:

a speaker, said speaker having a speaker cover, said speaker cover attached to the second surface of said poster such that said speaker is concealed between said speaker cover and said second surface, wherein said speaker cover has an inner circle and an outer circle separated from said inner circle forming a sound chamber therebetween, and wherein said speaker is located in said inner circle of said speaker cover;

an electronic circuit including sound production component for producing a sound, operatively connected to said speaker, said electronic circuit comprised of:

a circuit board;

at least one battery attached to the circuit board;

a speech chip attaching a trigger to said electric circuit;

folding said second area over said human actuatable sound components; and sealing said second surface of said second area to said second surface of said first area, such that said human actuatable sound components are concealed between said second surface of said second area and said second surface of said first area.

3. The method of claim 2 further comprising securing said human actuatable sound components onto said second surface of said poster before sealing said second surface of said second area to said second surface of said first area.

* * * * *